US011612895B2

(12) United States Patent
Harbold et al.

(10) Patent No.: US 11,612,895 B2
(45) Date of Patent: Mar. 28, 2023

(54) GRINDING ROLL AND A GRINDING ASSEMBLY COMPRISING THE GRINDING ROLL

(71) Applicant: Metso Outotec USA Inc., Waukesha, WI (US)

(72) Inventors: Keith Harbold, York, PA (US); Vadim Reznitchenko, Mechanicsburg, PA (US)

(73) Assignee: Metso Outotec USA Inc., Brookfield, WI (US)

( * ) Notice: Subject to any disclaimer, the term of this patent is extended or adjusted under 35 U.S.C. 154(b) by 149 days.

(21) Appl. No.: 17/355,447

(22) Filed: Jun. 23, 2021

(65) Prior Publication Data

US 2022/0410166 A1 Dec. 29, 2022

(51) Int. Cl.
*B02C 4/30* (2006.01)
*B02C 4/02* (2006.01)

(52) U.S. Cl.
CPC ..... *B02C 4/305* (2013.01); *B02C 4/02* (2013.01); *B02C 2210/02* (2013.01)

(58) Field of Classification Search
CPC ..... B02C 4/02; B02C 4/305
USPC ..... 241/293
See application file for complete search history.

(56) References Cited

U.S. PATENT DOCUMENTS

2013/0277478 A1* 10/2013 Gronvall ..... B02C 4/283 241/226
2022/0258170 A1* 8/2022 Schroers ..... B02C 4/32

FOREIGN PATENT DOCUMENTS

| | | | | |
|---|---|---|---|---|
| CN | 206868316 U | * | 1/2018 | |
| CN | 112295659 A | | 2/2021 | |
| DE | 4037816 A1 | * | 11/1990 | |
| DE | 102018108690 A1 | * | 10/2019 | ..... B02C 4/283 |
| EP | 2167234 A1 | | 3/2010 | |
| EP | 2756886 B1 | | 7/2014 | |

(Continued)

OTHER PUBLICATIONS

English translate (CN206868316U), retrieved date Nov. 28, 2022.*

(Continued)

*Primary Examiner* — Matthew Katcoff
*Assistant Examiner* — Mohammed S. Alawadi
(74) *Attorney, Agent, or Firm* — Andrus Intellectual Property Law, LLP

(57) ABSTRACT

A grinding roll including a roll body having a cylindrical outer surface extending axially between a first end and a second end and a flange attached to at least one of the first and second ends. The flange includes an outer edge that extends radially past the cylindrical outer surface of the roll body. A first surface of the flange forms a perpendicular continuing surface with the cylindrical outer surface of the roll body. A second surface of the flange forms a continuation of one of the first and second ends of the roll body. The flange includes wear protection liner elements on the first surface. The first surface of the flange includes at least one lower part adjacent the cylindrical outer surface of the roll body and at least one upper part adjacent the outer edge of the flange. The lower part includes a first type of wear protection liner elements and the upper part includes a second type of wear protection liner elements. The average covering area of the second type of wear protection liner elements is larger than that of the first type of wear protection liner elements.

16 Claims, 6 Drawing Sheets

(56) References Cited

FOREIGN PATENT DOCUMENTS

| | | | |
|---|---|---|---|
| WO | 2019197240 | A1 | 10/2019 |
| WO | WO-2020143997 | A1 * | 7/2020 |

OTHER PUBLICATIONS

English translate (DE4037816A1), retrieved date Nov. 28, 2022.*
English translate (DE102018108690A1), retrieved date Nov. 28, 2022.*
English translate (WO2020143997A1), retrieved date Nov. 28, 2022.*
International Search Report and Written Opinion for International Application No. PCT/US2022/034140, dated Jan. 3, 2023.

* cited by examiner

GRINDING ROLL AND A GRINDING ASSEMBLY COMPRISING THE GRINDING ROLL

FIELD OF THE DISCLOSURE

The present disclosure relates to a grinding roll and a grinding assembly for comminution of materials comprising the grinding roll.

BACKGROUND

When comminuting or crushing materials, such that rock, ore, cement clinker or other hard materials, using grinding assemblies or the like is well known in the art. The grinding assembly may have two grinding rolls for the pressure comminution of materials. Preferably, the two grinding rolls are arranged generally parallel and configured to rotate opposite directions, towards each other, wherein the two grinding rolls are separated by a gap. The material to be comminuted is fed by gravity or choke-fed into the gap. One type of grinding assembly is called high pressure grinding rollers or high pressure roller crusher. Sometimes, this type of grinding assembly uses a crushing technique called interparticle crushing. Here, the material to be comminuted or crushed is crushed not only by the crushing surface of the rolls, but also by particles in the material to be comminuted or crushed, hence the name interparticle crushing. However, a problem that may occur when feeding the material into the gap is to keep the material between the grinding roll(s) and to direct the material into the gap.

In an attempt to meet this problem, European Patent EP2756886B1 suggests introducing flanges on one of the two grinding rolls.

Such flanges are exposed to a lot of wear from the material to be crushed, but the flanges are also exposed to pressure exerted by the material.

Further, flanges may be exposed to different amount of wear on different parts of the flange.

Even further, such flanges may, in case of skewing, interfere with the edges of the opposite grinding roll and cause damage to both the flanges as well as the edges of the opposite grinding roll.

Thus, the conventional grinding rolls arranged with flanges are associated with several drawbacks. There is thus a need in the art for an improved flange.

SUMMARY

An object of the disclosure is to provide for an increased life of the flange during operation of a grinding assembly.

Another object of the disclosure is to provide for an improved flange design compared to conventional flanges known in the art.

Another object of the disclosure is to provide for a more stable grinding roll during skewing events, wherein the grinding roll comprises at least one flange.

According to a first aspect of the disclosure, these and other objects are achieved, in full or at least in part, by a grinding roll comprising:

a roll body having a cylindrical outer surface extending axially between a first end and a second end of the roll body;

a flange attached to at least one of the first and second end of the roll body;

the flange having an outer edge that extends radially past the cylindrical outer surface of the roll body;

the flange having a first surface and a second surface, the first surface forming a perpendicular continuing surface with the cylindrical outer surface of the roll body, and the second surface forms a continuation of the at least one of the first and second end of the roll body; and the flange comprises wear protection liner elements on the first surface.

According to the disclosure liner elements on the first surface comprises at least one radially lower part adjacent the cylindrical outer surface, and at least one radially upper part adjacent the outer edge of the flange, wherein the at least one radially lower part comprises a first type of wear protection liner elements and the at least one radially upper part comprises a second type of wear protection liner elements, and wherein an average covering area of the second type of wear protection liner elements is larger than that of the first type of wear protection liner elements.

By the term "attached" is here meant that the flange is fastened or mounted to, or in close proximity to, the at least one of the first and second end of the roll body in order to be kept in place. The flange is attached to the at least one of the first and second end of the roll body by means of a bolt and nut arrangement or screws. However, it should be noted that adhesives, welding, Velcro, magnets, or other, similar means may be used as well. In this way, it is possible to remove or replace the flange in an easy way. According to one non-limiting example, the flange may be attached to the roll body in one piece, wherein the flange is in one piece. According to another non-limiting example, the flange may be divided into a plurality of segments, wherein each segment may be attached to the roll body. The flange may be divided into the plurality of segments in order to facilitate manufacturing and mounting of the same. Preferably, the plurality of segments may be attached to each other by stitch plates, sometimes also called fish plate or joint plates, or the like.

By the term "first surface" is here meant a surface facing inwardly over the cylindrical outer surface of the roll body and forming a perpendicular continuing surface with the cylindrical outer surface.

By the term "second surface" is here meant the surface of the flange facing exterior or outwardly of the roller body forming a continuing surface with the at least one of the first and second end of the roll body.

When the flange is attached to the at least one of the first and second end of the roll body, the first surface is exposed to a lot of wear from the material during operation, while the second surface is not. Thus, it is the first surface that should be improved such that the lifetime of the flange may be increased. Therefore, by introducing wear protection liner elements on the first surface of the flange, it is possible to provide for a more durable flange such that the lifetime of the flange is increased.

The disclosed grinding roll may be advantageous as it allows for the wear protection liner elements to vary over the first surface of the flange, wherein the radially lower part comprises the first type of wear protection liner elements and the radially upper part comprises the second type of wear protection liner elements. This is advantageous because the radially lower and the radially upper part of the first surface of the flange usually are exposed to different wear. By introducing the first and second types of wear protection liner elements, wherein an average covering area of the second type of wear protection liner elements is larger than that of the first type of wear protection liner elements, provides for that it is possible to tailor the respective type of wear protection liner elements based on the wear on the flange. Although the average covering area of the second type of wear protection liner elements is larger than that of the first type of wear protection liner element, it should be noted that a covering area of individual elements of the second type of wear protection liner elements may be smaller than a covering area of individual element of the first type of wear protection liner element and vice versa. Preferably, the first type of wear protection liner elements should be fabricated with high strength "ductile" material to resist high load. Preferably, the second type of wear protection liner elements uses a wear resistant material such that tungsten carbide or ceramics. With the present disclosure, a more durable flange and hence, the lifetime of the flange may be improved.

According to an embodiment, the covering area of each of the second type of wear protection liner elements is larger than that of each of the first type of wear protection liner elements.

According to an embodiment, the first type of wear protection liner elements is arranged as a mosaic pattern on the at least one radially lower part of the flange.

An advantage with this embodiment is that efficient use of the first type of wear protection liner elements is provided. Thus, in the at least one radially lower part of the flange, there are little or no material movements in relation to the first surface of the flange during operation and hence, the lower part is not exposed to excessive abrasive wear based on the material movements. All material in the lower part of the flange may be exposed to crushing forces and the material is moving with the flange and hence, creates little or no abrasive wear on the flange. As there is little or no abrasive wear on the flange in this radially lower part of the flange, there is no need for a wear protection liner element with full covering of the flange. On the other hand, this area may be subjected to large axial forces, which may cause the first type of wear protection liner elements to crack should each wear protection liner elements have a large covering area. Thus, this first type of wear protection liner elements is preferably arranged in a mosaic pattern. The wear protection liner elements may have a hexagonal shape and may be arranged such that they do not cover the entire surface of this area.

According to an embodiment, the first type of wear protection liner elements comprises studs arranged in recesses provided in the at least one radially lower part of the flange.

An advantage with this embodiment is that the studs may be removable or replaceable when worn out. Again, as discussed in previous embodiment, the low or no abrasive wear in this area allows for not fully covering wear protection. Instead the axial forces are more troublesome in this area. Studs having a small wear protection liner area facing the axial forces of the material to be grinded and having an axial extension within the flange will handle these axial forces well in this at least one radially lower part of the flange. Such studs are easy to manufacture. Hence, this embodiment may provide for an increased lifetime of the flange.

According to an embodiment, the second type of wear protection liner elements comprises tile plates removably arranged in a close pattern along at least one radially upper part adjacent the outer edge of the flange.

An advantage with this embodiment is that the lifetime of the flange is further improved.

A further advantage with this embodiment, and especially with the tile plates, is that this material is hard, but brittle, which is preferred features for the second type of wear protection liner elements. Thus, in the at least one radially upper part adjacent the outer edge of the flange, the flange is exposed to a lot of abrasive wear but low axial load, therefore it is preferably that the wear protection liner elements in this radially upper part of the flange is harder and each wear protection liner elements covering larger area.

By the disclosed design, where the tile plates are arranged in a close pattern facilitates provision of an improved protection against abrasive wear. Thus, when the tile plates are arranged in the close pattern, the flange is protected against wear to a greater extend compared to e.g. when the first type of wear protection liner elements being arranged as a mosaic pattern as discussed above. Usually, the at least one radially upper part is exposed to a lot of wear from e.g. material movements. Therefore, by this arrangement, the lifetime of the flange may be further improved.

In addition, by the term "removably arranged" is here meant that the tile plates may be removed and replaced in an easy way when they are worn out. Thus, instead of replacing the flange, it is possible to replace the tile plates instead. Preferably, the tile plates are arranged on the at least one radially upper part adjacent the outer edge of the flange by using a nut and bolt arrangement or screws, but adhesive or other similar means may also be used.

According to an embodiment, an elastic shim is arranged between the second type of wear protection liner elements and the flange.

An advantage with this embodiment is that the impact on the flange during skewing events may be reduced. Thus, introducing the elastic shim between the second type of wear protection liner elements and the flange will reduce the impact on the flange and an edge on the opposite roller body during skewing events that may occur during operation of the grinding roll in a grinding assembly. A further advantage with this embodiment is that a stable grinding roll during operation, and especially during skewing events, may be achieved. Preferably, the elastic shim is arranged between the second type of wear protection liner elements and the flange by using a nut and bolt arrangement or screws. However, other fastening or mounting arrangements may be possible as well.

According to an embodiment, the elastic shim comprises a spring assembly arranged between the second type of wear protection liner elements and the flange. The spring assembly may be attached between the second type of wear protection liner elements and the flange by installing the spring assembly from a second surface of the flange, through the flange, towards the second type of wear protection liner elements arranged on the first surface of the flange.

According to an embodiment, the elastic shim comprises a rubber mat, or a spring assembly.

According to an embodiment, the grinding roll having a flange attached to each of the first and second end of the roll body.

According to a second aspect of the disclosure, these and other objects are also achieved, in full or at least in part, by a grinding assembly for comminution of material, comprising two generally parallel grinding rolls arranged to rotate in opposite direction, towards each other, and separated by a gap, wherein the grinding assembly comprises at least one grinding rolls as disclosed with respect to the first aspect.

According to an embodiment, the grinding assembly comprises two grinding rolls, wherein each grinding roll having a flange attached to one of the first and second end of the roll body. Preferably, when the grinding rolls are arranged to rotate in opposite direction, towards each other, the flange on respective grinding roll should be positioned on opposite sides of the respective grinding roll.

According to another embodiment, the grinding assembly comprises two grinding rolls, wherein one of the two grinding rolls having two flanges attached to the first and second end of the roll body, and the other one having no flanges.

It should be noted that these embodiments are only examples and other arranged within the present disclosure is possible as well.

According to a third aspect of the disclosure, these and other objects are also achieved, in full or at least in part, by a flange ring segment arrangeable at a grinding roll along an edge thereof, the flange ring segment comprising a first surface and a second surface, the first surface forming a perpendicular continuing surface with a cylindrical outer surface of a grinding roll when arranged thereat, and the second surface forming a continuation of the an end of the grinding roll when arranged thereat; and the flange ring segment comprising wear protection liner elements on the first surface.

According to the disclosure the first surface comprising at least one radially lower part adjacent the cylindrical outer surface of the grinding roll when arranged thereat and at least one radially upper part adjacent an outer edge of the flange ring segment, wherein the at least one radially lower part comprises a first type of wear protection liner elements and the at least one radially upper part comprises a second type of wear protection liner elements, and wherein an average covering area of the second type of wear protection liner elements is larger than that of the first type of wear protection liner elements.

According to an embodiment, the first type of wear protection liner elements is arranged as a mosaic pattern on the at least one radially lower part of the flange ring segment.

According to an embodiment, the first type of wear protection liner elements comprises studs arranged in recesses provided in the at least one radially lower part of the flange ring segment.

According to an embodiment, the second type of wear protection liner elements comprises tile plates removably arranged in a close pattern along at least one radially upper part adjacent the outer edge of the flange ring segment.

According to an embodiment, an elastic shim is arranged between the second type of wear protection liner elements and the flange ring segment.

According to an embodiment, the elastic shim comprises a rubber mat or a spring assembly.

Other objectives, features, and advantages of the present disclosure will appear from the following detailed disclosure, from the attached claims, as well as from the drawings. It is noted that the disclosure relates to all possible combinations of features.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of the element, device, component, means, step, etc., unless explicitly stated otherwise. The steps of any method disclosed herein do not have to be performed in the exact order disclosed, unless explicitly stated.

As used herein, the term "comprising", and variations of that term are not intended to exclude other additives, components, integers, or steps.

BRIEF DESCRIPTION OF THE DRAWINGS

The disclosure will be described in more detail with reference to the appended schematic drawings, which show an example of a presently preferred embodiment of the disclosure.

DETAILED DESCRIPTION

Figure 1:
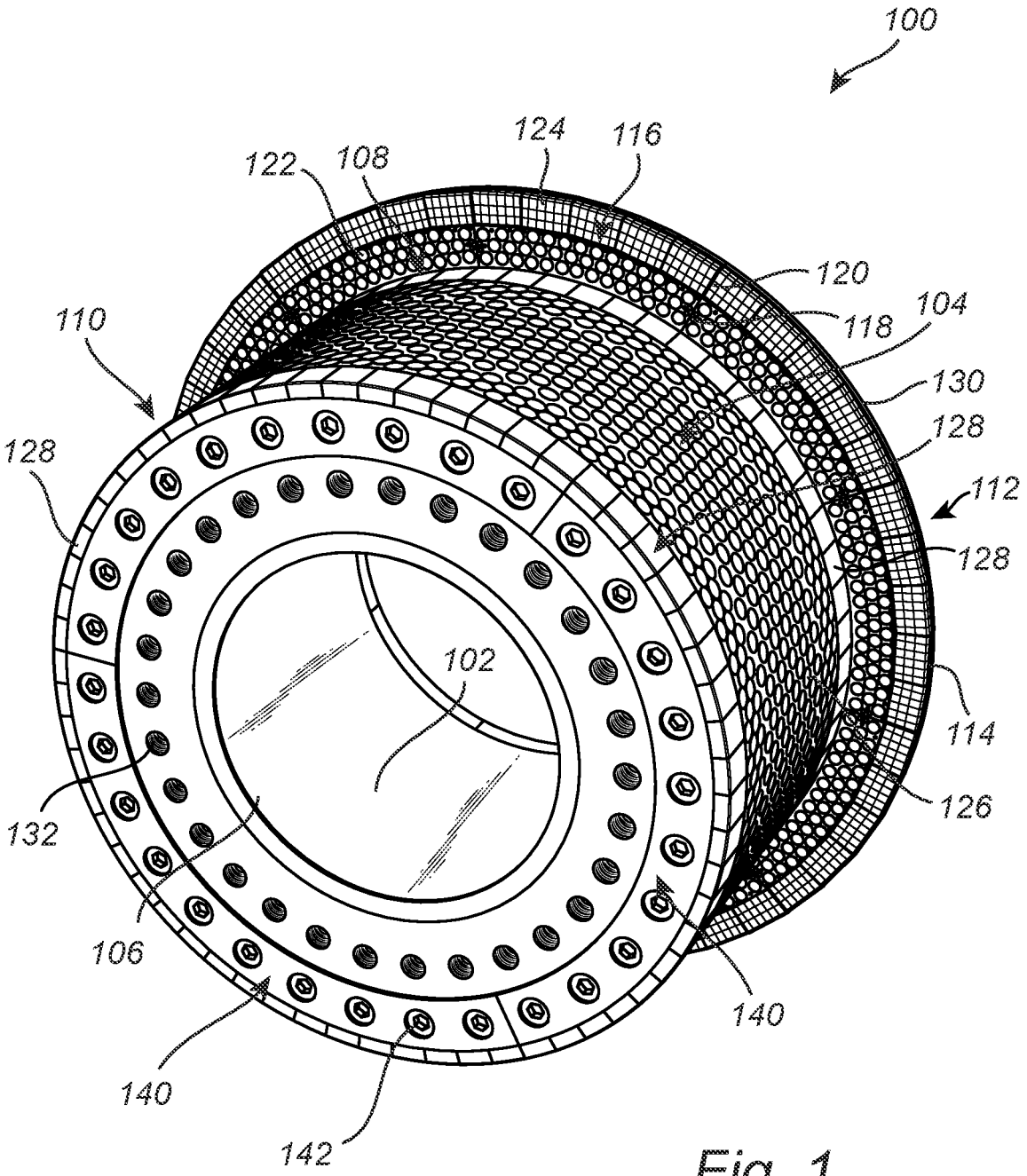
FIG. 1 is an isomeric view of a grinding roll.

The present disclosure will now be described more fully hereinafter with reference to the accompanying drawings, in which currently preferred embodiments of the disclosure are shown. The present disclosure may, however, be embodied in many different forms and should not be construed as limited to the embodiments set forth herein; rather, these embodiments are provided for thoroughness and completeness, and to fully convey the scope of the disclosure to the skilled addressee. Like reference characters refer to like elements throughout.

FIG. 1 illustrates a grinding roll 100. The grinding roll 100 may be used in a grinding assembly 200 for comminution of materials. The grinding assembly is further illustrated and discussed in connection with FIGS. 2A-B and 5. The grinding roll 100 comprises a roll body 102. The roll body 102 has a cylindrical outer surface 104 and a cylindrical inner surface 106. The cylindrical outer surface 104 extend axially between a first end 108 and a second end 110 of the roll body 102. Preferably, the roll body 102 is made of a durable, metallic material.

The roll body 102 comprises a flange 112. The flange 112 is attached to the first end 108 of the roll body 102. The flange 112 has an outer edge 114. The outer edge 114 of the flange 112 extends radially past the cylindrical outer surface 104 of the roll body 102. The flange 112 may be attached to the roll body by bolt arrangement 210, see e.g. FIG. 2A. However, it should be noted that the grinding roll 100 may comprise another flange 112 attached to the second end 110 of the roll body 102. Thus, the grinding roll 100 may comprise at least one or two flange(s) being attached to the first end 108 and/or the second end 110 of the roll body 102. With reference to FIG. 1, the flange 112 is formed from a plurality of separate flange segments 130. Preferably, the flange 112 may be formed of any number of flange segments 130. However, it should be noted that the flange 112 may be arranged as one single unitary section as well or as an integral part of the roll body.

The flange 112 has a first surface 116 forming a perpendicular continuing surface with the cylindrical outer surface 104 of the roll body 102. The flange 112 has a second surface 208 forming a continuation of the at least one of the first and the second end 108, 110 of the roll body 102 (see FIG. 2A-B for the second surface). The first surface 116 comprises at least one radially lower part 118 and at least one radially upper part 120. The at least one radially lower part 118 is adjacent the cylindrical outer surface 104 of the roll body 102. The at least one radially upper part 120 is adjacent the outer edge 114 of the flange 112. The at least one radially lower part 118 comprises a first type of wear protection liner elements 122. The at least one radially upper part 120 comprises a second type of wear protection liner elements 124. The first and the second type of wear protection liner elements 122, 124 is further discussed in connection with FIGS. 2A-B and 3A.

The roll body 102 comprises a series of receiving bores that extends radially into the roll body 102 from the cylindrical outer surface 104. Each of the receiving bores receives a stud 126. Each of the studs 126 is formed from a material that is more durable than the roll body 102. The studs 126 may be replaced when worn to extend the life of the grinding roll 100. Preferably, the top end of the stud 126 extends past the cylindrical outer surface 104 such that material contacting the grinding roll 100 is first engaged by the top end of the stud 126. The crushed material forms a bed of material between the studs 126 to also enhance the durability of the cylindrical outer surface 104.

The roll body 102 comprises a plurality of edge wear protection bodies 128. The plurality of edge wear protection bodies 128 are arranged along the circumference of the roll body 102. The plurality of edge wear protection bodies 128 extends from the first end 108 or the second end 110 of the roll body 102 to the series of receiving bores.

The plurality of edge wear protection bodies 128 may preferably be arranged on an edge ring or edge segments 140 forming an edge ring.

However, it should be noted that the roll body 102 may be arranged without the series of the receiving bores and/or the edge wear protection bodies 128 such that the cylindrical outer surface 104 of the roll body 102 is smooth without any studs 126 and/or edge wear protection bodies 128.

The roll body 102 further comprises holes 132. The holes 132 may be configured to receive a bolt, screw, or the like in order to attach the flange 112 to the roll body 102. Preferably, there are holes 132 arranged along the periphery of the first end 108 and/or second end 110 of the roll body 102 in order to attach the flange 112 in a simple and secure way. Preferably, the holes 132 are pre-drilled holes in order to attach the flange 112 in an easy way.

In a similar way the roll body 102 may comprise an additional circle of holes configured to receive a bolt 142, screw or the like in order to attach the edge segments 140 or edge ring with edge wear protection bodies 128.

Figure 2A:
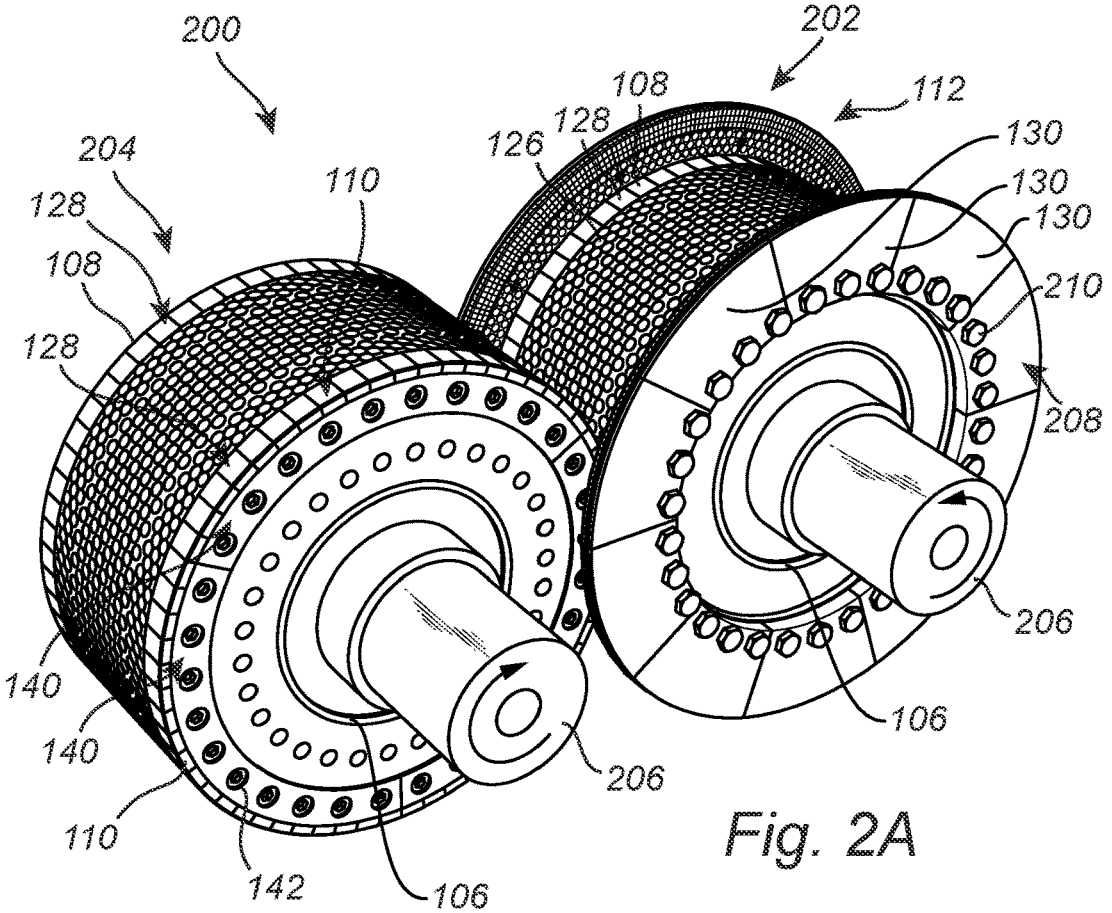
FIG. 2A is an isomeric view of a grinding assembly including a first grinding roll constructed in accordance with an embodiment of the present disclosure, and a second grinding roll.
Figure 2B:
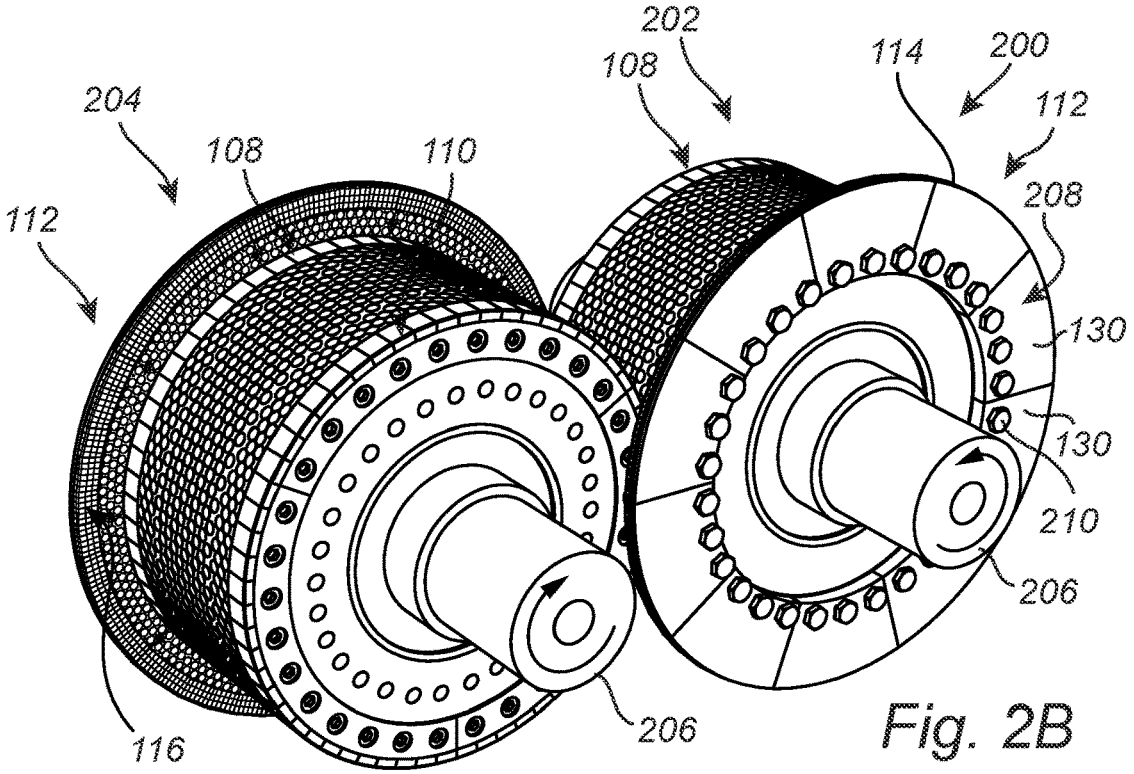
FIG. 2B is an isomeric view of a grinding assembly including two grinding rolls constructed in accordance with and embodiment of the present disclosure.

FIGS. 2A-B illustrates different arrangements of the grinding assembly 200 for comminution of material by way of example. The grinding assembly 200 comprises a first and a second grinding roll 202, 204 being generally arranged in parallel. The first and second grinding rolls 202, 204 are each respectively rotatable about a respective shaft 206 in opposite directions, towards each other. The roll body 102 of respective grinding roll 202, 204 extends along and is rotatable about a longitudinal axis that passes through the center of the shaft 206. Preferably, the inner surface 106 of the roll body 102 receives and engages the shaft 206 that imparts rotation to the grinding roll 202, 204. The two generally parallel grinding rolls 202, 204 are separated by a gap. A mechanical source of pressure (not shown) bias the first and second grinding rolls 202, 204 towards each other such that the source of pressure crushes the material passing through the gap.

Figure 5:
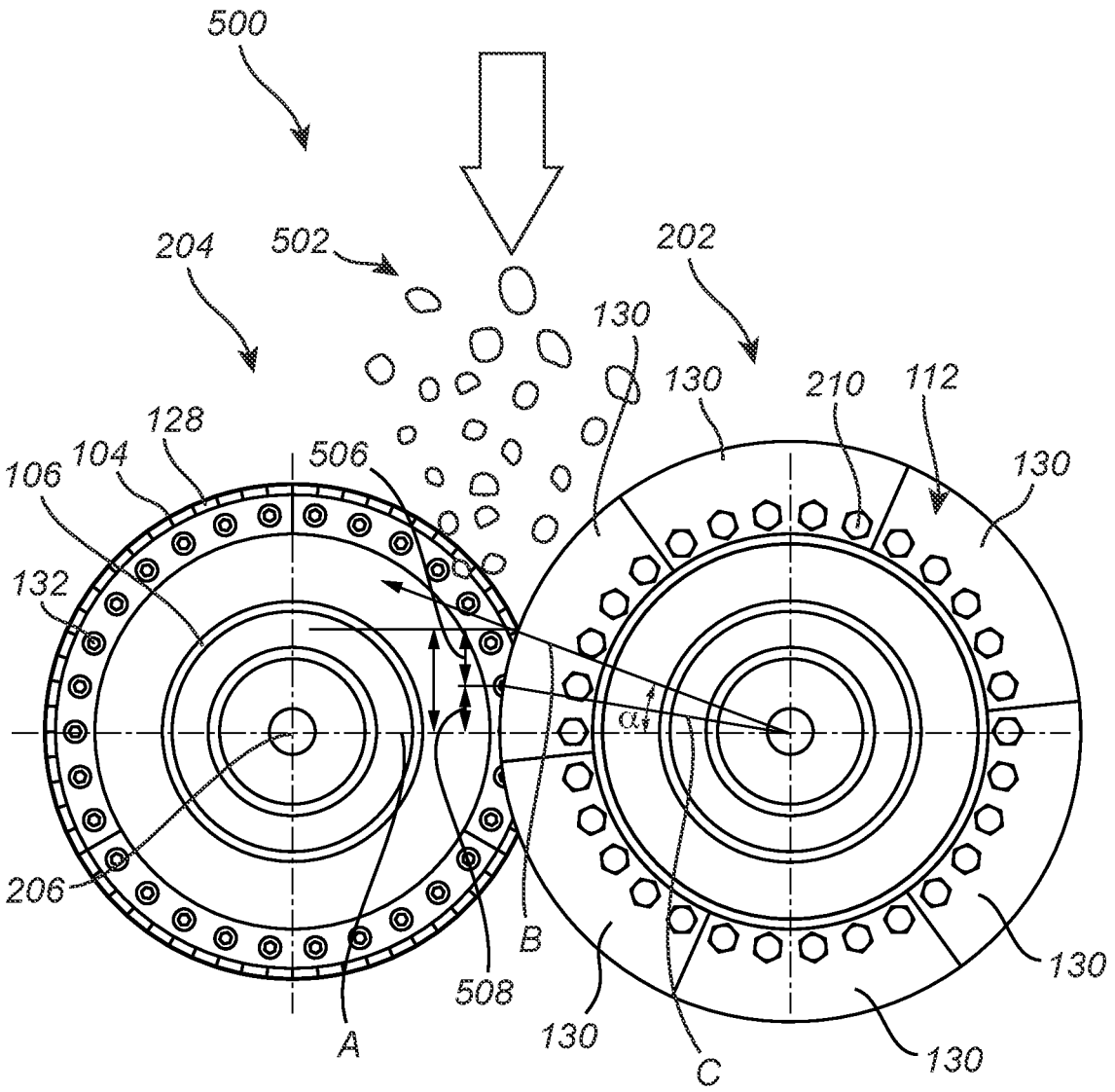
FIG. 5 is a side view of the grinding assembly in FIG. 2A.

With reference to FIG. 5, and also to FIGS. 1-3B, a grinding assembly 500 during operation, wherein material 502 is drawn into the gap, is illustrated by way of example. The grinding assembly 500 comprises the first grinding roll 202 and the second grinding roll 204. The first grinding roll 202 comprises flanges 112 attached to the first and second end 108, 110 of the roll body 102.

A first straight line A has been drawn from the center of the first grinding roll 202 to the center of the second grinding roll 204.

A second straight line B has been drawn from the center of the first grinding roll 202 to and through a first point on the first grinding roll 202, at which first point an active engagement between the second grinding roll 204 and the material to be crushed is started. The angle formed between the first straight line A and the second straight line B is defined as a nip angle $\alpha$.

A third straight line C has been drawn from the center of the first grinding roll 202 to and through a second point on the first grinding roll 204, at which second point an active crushing of the material between the first and second grinding rolls 202, 204 starts during operation of the grinding assembly 500.

The distance between the first point and the second point, as seen along the cylindrical outer surface 104 of the second grinding roll 204, defines a pre-compressed section 506 during operation of the grinding assembly 500. In the pre-compressed section 506, the outer edge 114 of the flange 112 attached to the first grinding roll 202 extends sufficient radially past the cylindrical outer surface 104 of the first grinding roll 202 to extend across the gap between the first and the second grinding rolls 202, 204 to a point on the second grinding roll 204, at which point the active engagement between the second grinding roll 204 and the material 502 to be crushed starts. In the pre-compressed section 506, the flanges 112 are configured to keep the material 502 between the grinding rolls 202, 204 such that the material 502 may be moved into a crushing section 508 between the grinding rolls 202, 204. In the pre-compressed section 506, there may be a lot of material movements when the material 502 forms the compact bed of material without any voids therein. Those movements may create a lot of abrasive wear on the at least one radially upper part 120 of the first surface 116 of the flanges 112. However, the axial load on the at least one radially upper part 120 of the first surface 116 of the flanges 112 is low in the pre-compressed section 506.

The distance between the second point and the first straight line, as seen along the cylindrical outer surface 104 of the second grinding roll 204, defines a crushing section 508 during the operation of the grinding assembly 500. In the crushing section 508, the at least one radially lower part 118 of the first surface 116 of the flanges 112 extends sufficient radially across the gap, and the at least one radially upper part 120 of the flange 112 are aligned with a peripheral outer section of the first and/or second end 108, 110 of the second grinding roll 204. In the crushing section 508, there is no voids in the material 502. As a consequence, there is no material movements in the crushing section 508 in relation to the at least one radially lower part 118 of the first surface 116 of the flanges 112 and hence, low or no abrasive wear on the at least one radially lower part 118 of the first surface 116 of the flanges 112. All material 502 present in this section is exposed to crushing forces.

A different between the pre-compressed section 506 and the crushing section 508 is that the material 502 in the pre-compression section moves in relation to the flanges 112, while the material 502 in the crushing section 508 moves with the at least one flange 112. On the other hand, the material 502 in the crushing section 508 do exert a significant axial force on the flanges 112.

Thus, in the pre-compressed section 506, the at least one radially upper part 120 and the at least one radially lower part 118 extends across the gap, wherein the at least one radially upper part 120 is exposed to a lot of abrasive wear due to the material movements in this section during operation of the grinding assembly 500. In the crushing section 508, the at least one radially lower part 118 extends across the gap, wherein the at least one radially lower part 118 is exposed to less or no abrasive wear but to a significant axial force during operation of the grinding assembly 500.

As the at least one radially lower part 118 and the at least one radially upper part 120 may be exposed to different type of wear, e.g. abrasive wear from the moving material and wear in form of axial forces, these should be covered with different wear protection liner elements in order to provide for an increased life of the flange 112.

Referring back to FIG. 1, wherein the first type of wear protection liner elements 122 and the second type of wear protection liner elements 124 was introduced. The at least one radially lower part 118, which is exposed to mainly axial force during operation of the grinding assembly 200, 500, comprises the first type of wear protection liner elements 122. The at least one radially upper part 120, which is exposed to a lot of abrasive wear from the moving material 502 during operation of the grinding assembly 200, 500, comprises the second type of wear protection liner elements 124. Preferably, each second type of wear protection liner elements 124 has a larger covering area than each first type of wear protection liner elements 122. Since the at least one radially upper part 120 is exposed to a lot of abrasive wear during operation, the at least one radially upper part 120 should preferably be covered to a larger extend compared to the at least one radially lower part 118, which is also illustrated in the figures of this disclosure. Preferably, the second type of wear protection liner elements 124 is arranged in a closer pattern compared to the pattern of the first type of wear protection liner elements 122. The arrangement of the first and the second type of wear protection liner elements 122, 124 is discussed in further detail in connection with FIG. 3A.

Referring back to FIG. 2A, the grinding assembly 200 comprises one grinding roll 100 as discussed in connection with FIG. 1, herein referred to the first grinding roll 202. The first grinding roll 202 comprises one flange 112 attached to the first end 108 of the roll body 102 and one flange 112 attached to the second end 110 of the roll body 102. The second grinding roll 204 in the grinding assembly 200 is similar to the grinding roll 100 discussed in connection with FIG. 1 expect that there are no flange(s) 112 attached to the roll body 102.

Further to what have been discussed above, a second surface 208 of the flange 112 is illustrated. The flanges 112 are arranged with nut and bolt arrangement 210 for attaching the flange 112 to the roll body 102. It should be noted that other attaching arrangement may be used as well.

With reference to FIG. 2B, the grinding assembly 200 comprises two grinding rolls 100 as discussed in connection with FIG. 1. The first grinding roll 202 comprises one flange 112 attached to the second end 110 of the roll body 102, and the second grinding roll 204 comprises one flange 112 attached to the first end 108 of the roll body 102.

Figure 3A:
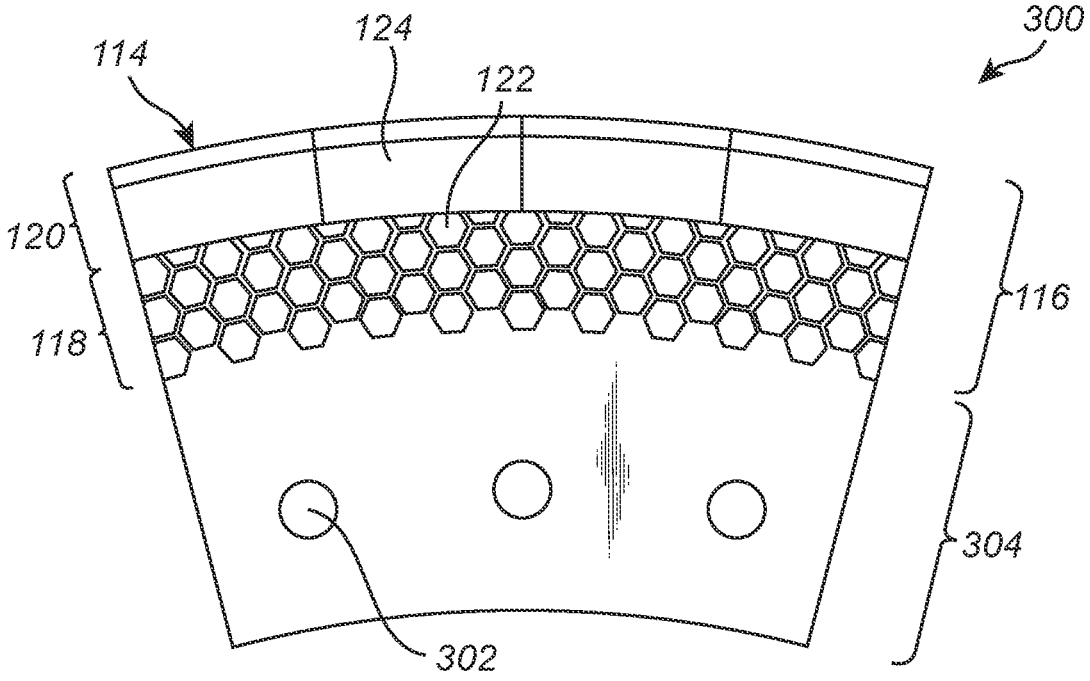
FIG. 3A illustrates a flange segment in accordance with an embodiment of the present disclosure.
Figure 3B:
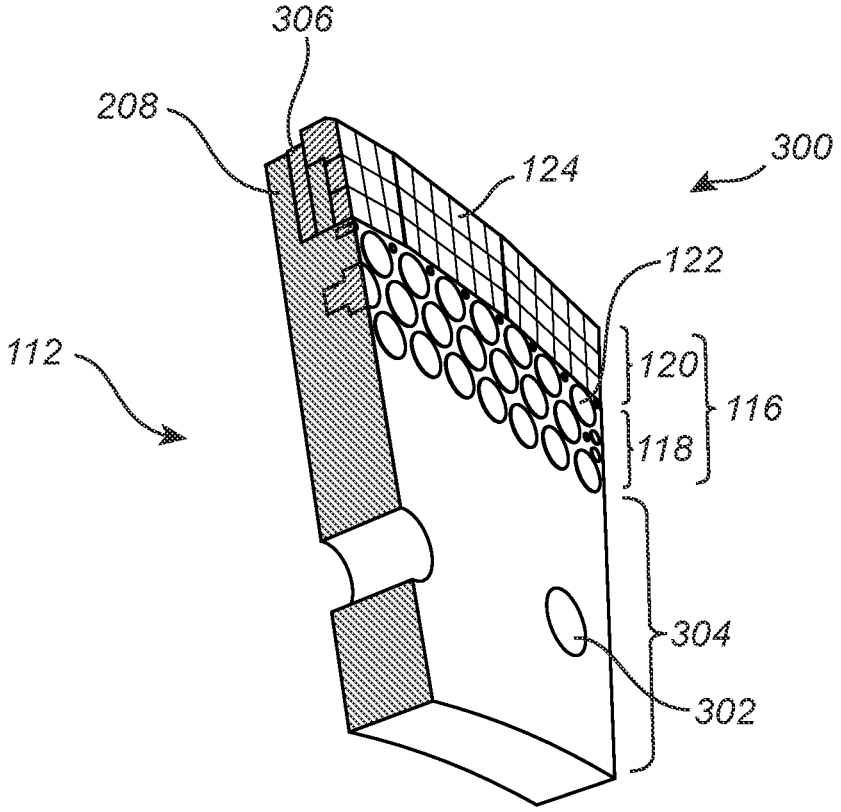
FIG. 3B-C illustrates a cross section of a flange segment comprising an elastic shim in accordance with an embodiment of the present disclosure.
Figure 3C:
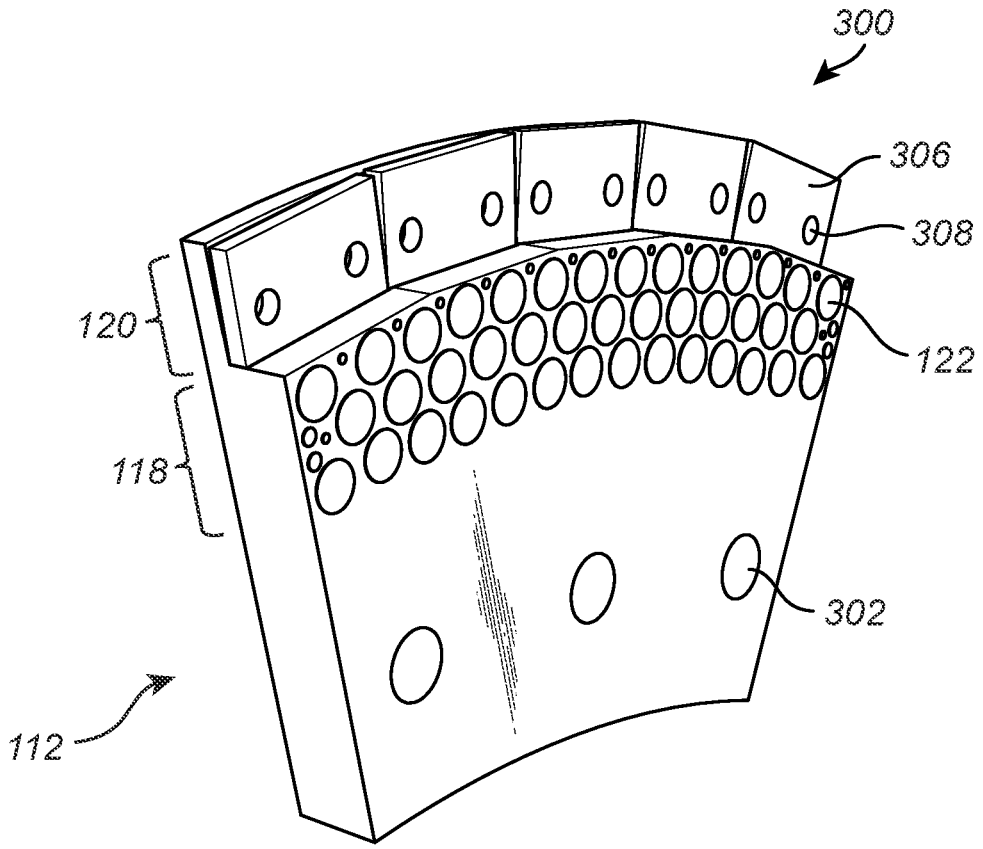

FIG. 3A-C illustrates one flange segment 130 for forming the flange 112 from different point of views. FIG. 3A further illustrates a front view of the flange segment 130. FIG. 3B-C illustrates a cross section of the flange segment 130. The flange segment 130 is in line with, and has the same features as, the flange 112 that has been discussed above in connection with FIGS. 1, 2A-B and 5. FIG. 3A-C also illustrates the first type of wear protection liner elements 122 and the second type of wear protection liner elements 124 in further detail.

As best illustrated in FIG. 3A, the first type of wear protection liner elements 122 is arranged as a mosaic pattern on the at least one radially lower part 118 of the flange segment 130. However, it should be noted that the first type of wear protection liner elements 122 may be arranged in any suitable pattern in order to withstand the axial force during operation of the grinding assembly 200, 500. According to one non-limiting example, the first type of wear protection liner elements 122 may comprise studs arranged in recesses provided in the at least one radially lower part 118 of the flange segment 130. Thus, the first type of wear protection liner elements 122 may be arranged in the similar way as on the cylindrical outer surface 104 of the roll body 102 discussed in connection with FIG. 1. The second type of wear protection liner elements 124 comprises tile plates arranged in a close pattern along at least one radially upper part 120 adjacent the outer edge 114 of the flange 112. Preferably, the tile plates are removably arranged along the at least one radially upper part 120 such that the tile plates may be replaced when worn in order to increase the life of the flange segment 130.

Each flange segment 130 further comprises a section 304 arranged to be aligned with the first 108 and/or second end 110 of the roll body 102. This section comprises holes 302. The holes 302 may be aligned with corresponding holes in the roll body 102, which holes are arranged along the periphery of the first 108 and/or the second end 110 of the roll body 102. In this way the flange 112 may be attached in a simple and secure way. These holes 302 may be configured to receive a bolt, screw, or the like in order to attach the flange 112 to the roll body 102. Preferably, the holes 302 are pre-drilled holes in order to attach the flange 112 in an easy way. Obviously, other fastening means than bolting are conceivable.

Further to what have been discussed above, FIG. 3B illustrates an elastic shim 306. The elastic shim 306 is arranged between the second type of wear protection liner elements 124 and the flange 112. The elastic shim 306 is arranged to reduce impact on the flange 112 during skewing events and thereby also increase the life of the flange 112. According to one non-limiting example, the elastic shim 306 may comprise a rubber mat. Preferably, the elastic shim 306 slide into place for the best fitting. Preferably, the elastic shim is arranged between the second type of wear protection liner elements 124 and the flange 112 by using a bolt and nut arrangement or the like.

FIG. 3C illustrates a similar view as FIG. 3B but herein, without the second type of wear protection liner elements 124 such that the elastic shim 306 is shown in a better view. The elastic shim 306 may be arranged from a plurality of elastic shim segments as illustrated in the figure. However, it should be noted that the elastic shim 306 may be arranged as one single unitary section as well. The elastic shim 306 comprises one or more holes 308. The holes 308 are arranged to attach the elastic shim 306 to the flange 112 in a simple and secure way. These holes 308 may be configured to receive a bolt, screw, or the like in order to attach the elastic shim 306 to the flange 112. Preferably, the holes 308 are pre-drilled holes in order to attach the elastic shim in an easy way.

Figure 4A:
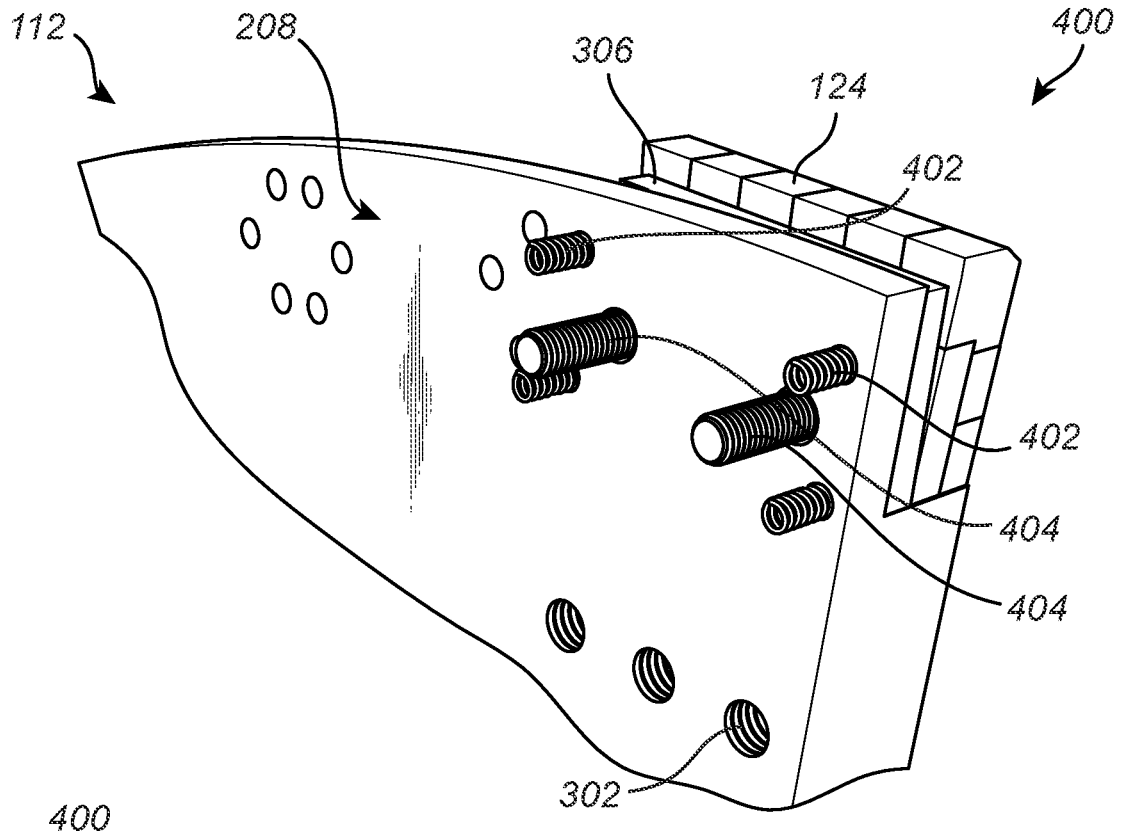
FIG. 4A-B illustrates a cross section of a flange segment comprising a spring load in accordance with an embodiment of the present disclosure.
Figure 4B:
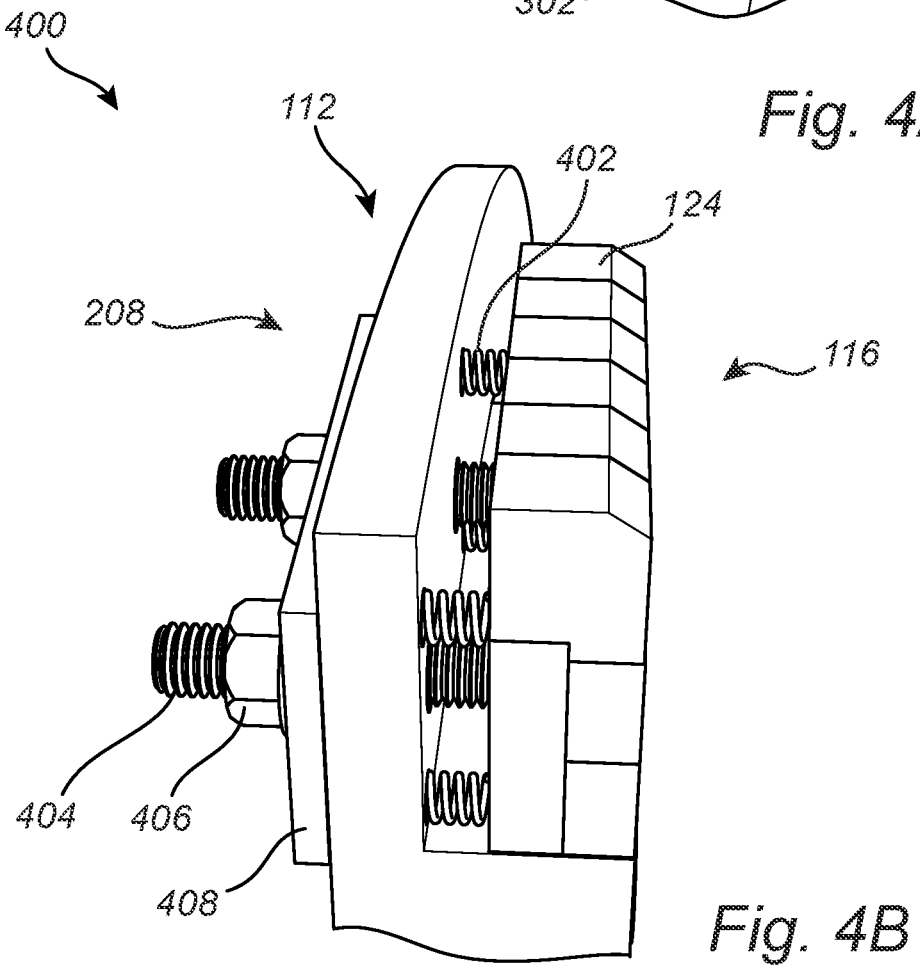

With reference to FIG. 4A-B and according to another non-limiting example, the elastic shim 306 may comprise a spring assembly 402 in order to facilitate the similar provision, namely, to reduce the impact on the flange 112 during skewing events. The spring assembly 402 is arranged between the second type of wear protection liner elements 124 and the flange 112. Although four springs are illustrated for the spring assembly 402 in FIG. 4A-B, it should be noted that any number of springs may be used for the spring assembly 402. Preferably, the second type of wear protection liner elements 124 is slided into place and thereafter, the spring assembly 402 is installed from the second surface 208 of the flange segment 130 as illustrated. A locking plate 408 is arranged on the second surface 208, outside the spring assembly 402, in order to keep the spring assembly 402 in place. It is further illustrated a nut and bolt arrangement 404, 406 for attaching the second type of wear protection liner elements 124 to the flange 112, which has been discussed above.

The skilled person realizes that a number of modifications of the embodiments described herein are possible without departing from the scope of the disclosure, which is defined in the appended claims.

For instance, the at least one radially upper and lower parts of the first surface of the flange may be of any suitable size and shape depending on the material to be comminution and on the type of grinding assembly that is used. The arrangement of the elastic shim may also vary depending on the grinding assembly.

The invention claimed is:

1. A grinding roll comprising:

a roll body having a cylindrical outer surface extending axially between a first end and a second end of the roll body;

a flange attached to at least one of the first and second end of the roll body, the flange having an outer edge that extends radially past the cylindrical outer surface of the roll body, the flange having a first surface and a second surface, the first surface forming a perpendicular continuing surface with the cylindrical outer surface of the roll body, and the second surface forms a continuation of the at least one of the first and second end of the roll body; and the first surface comprising at least one radially lower part adjacent the cylindrical outer surface of the roll body, and at least one radially upper part adjacent the outer edge of the flange, wherein the at least one radially lower part comprises a first type of wear protection liner elements and the at least one radially upper part comprises a second type of wear protection liner elements, and wherein an average covering area of the second type of wear protection liner elements is larger than that of the first type of wear protection liner elements.

2. A grinding roll according to claim 1, wherein the first type of wear protection liner elements is arranged as a mosaic pattern on the at least one radially lower part of the flange.

3. A grinding roll according to claim 1, wherein the first type of wear protection liner elements comprises studs arranged in recesses provided in the at least one radially lower part of the flange.

4. A grinding roll according to claim 1, wherein the second type of wear protection liner elements comprises tile plates removably arranged in a close pattern along at least one radially upper part adjacent the outer edge of the flange.

5. A grinding roll according to claim 1, wherein an elastic shim is arranged between the second type of wear protection liner elements and the flange.

6. A grinding roll according to claim 5, wherein the elastic shim comprises a rubber mat or a spring assembly.

7. A grinding roll according to claim 1, wherein the grinding roll includes a flange attached to each of the first and second end of the roll body.

8. A grinding assembly for comminution of material, comprising:

two parallel grinding rolls arranged to rotate in opposite direction, towards each other, and separated by a gap, wherein the at least one grinding roll comprises:

a roll body having a cylindrical outer surface extending axially between a first end and a second end of the roll body;

a flange attached to at least one of the first and second end of the roll body, the flange having an outer edge that extends radially past the cylindrical outer surface of the roll body, the flange having a first surface and a second surface, the first surface forming a perpendicular continuing surface with the cylindrical outer surface of the roll body, and the second surface forms a continuation of the at least one of the first and second end of the roll body; and the first surface comprising at least one radially lower part adjacent the cylindrical outer surface of the roll body, and at least one radially upper part adjacent the outer edge of the flange, wherein the at least one radially lower part comprises a first type of wear protection liner elements and the at least one radially upper part comprises a second type of wear protection liner elements, and wherein an average covering area of the second type of wear protection liner elements is larger than that of the first type of wear protection liner elements.

9. A flange ring segment arrangeable at a grinding roll along and edge thereof, the flange ring segment comprising a first surface and a second surface, the first surface forming a perpendicular continuing surface with a cylindrical outer surface of a grinding roll when arranged thereat, and the second surface forming a continuation of an end of the grinding roll when arranged thereat; and the first surface comprising at least one radially lower part adjacent the cylindrical outer surface of the grinding roll when arranged thereat and at least one radially upper part adjacent an outer edge of the flange ring segment, wherein the at least one radially lower part comprises a first type of wear protection liner elements and the at least one radially upper part comprises a second type of wear protection liner elements, and wherein an average covering area of the second type of wear protection liner elements is larger than that pf the first type of wear protection liner elements.

10. A flange ring segment according to claim 9, wherein the first type of wear protection liner elements is arranged as a mosaic pattern on the at least one radially lower part of the flange ring segment.

11. A flange ring segment according to claim 10, wherein the first type of wear protection liner elements comprises studs arranged in recesses provided in the at least one radially lower part of the flange ring segment.

12. A flange ring segment according to claim 9 wherein the first type of wear protection liner elements comprises studs arranged in recesses provided in the at least one radially lower part of the flange ring segment.

13. A flange ring segment according to claim 9, wherein the second type of wear protection liner elements comprises tile plates removably arranged in a close pattern along at least one radially upper part adjacent the outer edge of the flange ring segment.

14. A flange ring segment according to claim 13, wherein an elastic shim is arranged between the second type of wear protection liner elements and the flange ring segment.

15. A flange ring segment according to claim 9, wherein an elastic shim is arranged between the second type of wear protection liner elements and the flange ring segment.

16. A flange ring segment according to claim 15, wherein the elastic shim comprises a rubber mat or a spring assembly.

* * * * *